US006619285B2

(12) United States Patent
Hawkins, Jr. et al.

(10) Patent No.: US 6,619,285 B2
(45) Date of Patent: Sep. 16, 2003

(54) AMBIENT AIR BREATHING DEVICE

(76) Inventors: Albert D. Hawkins, Jr., 21 Oaknoll Ct., Elma, NY (US) 14059-9336; Steven J. Herberholt, 10352 Colterman Dr., St. Louis, MO (US) 63141

( * ) Notice: Subject to any disclaimer, the term of this patent is extended or adjusted under 35 U.S.C. 154(b) by 0 days.

(21) Appl. No.: 09/879,695

(22) Filed: Jun. 13, 2001

(65) Prior Publication Data

US 2003/0041861 A1 Mar. 6, 2003

(51) Int. Cl.[7] ..... A62B 7/04

(52) U.S. Cl. ..... 128/201.27; 128/201.28; 128/204.18; 128/205.24; 128/204.26; 137/38; 137/39

(58) Field of Search ..... 128/204.26, 202.14, 128/205.12, 205.27, 200.14, 200.24, 201.11, 201.27, 201.28, 203.25, 204.18, 205.24; 137/38, 39

(56) References Cited

U.S. PATENT DOCUMENTS 3,841,348 A * 10/1974 O'Neill ..... 137/494
4,344,427 A * 8/1982 Marvin ..... 128/200.25
4,552,153 A * 11/1985 Newman et al. ..... 600/490
4,574,797 A * 3/1986 Christianson ..... 128/204.26
4,694,847 A * 9/1987 Szlaga ..... 137/39
4,799,505 A * 1/1989 Nowell ..... 137/38
4,858,606 A * 8/1989 Hamlin ..... 128/204.22
5,035,238 A * 7/1991 Christianson ..... 128/204.26
5,379,762 A * 1/1995 Kobayashi ..... 128/201.28
5,603,315 A * 2/1997 Sasso, Jr. ..... 128/202.22
5,632,298 A * 5/1997 Artinian ..... 137/102
5,647,355 A * 7/1997 Starr et al. ..... 128/205.24
5,655,524 A * 8/1997 Atkins ..... 128/204.26
5,690,102 A * 11/1997 Bertheau et al. ..... 128/207.11
5,809,976 A * 9/1998 Cook et al. ..... 123/516
5,960,793 A * 10/1999 Matsuoka et al. ..... 128/201.26
5,971,203 A * 10/1999 Bae ..... 220/746
5,975,077 A * 11/1999 Hofstetter et al. ..... 128/204.24
6,039,043 A * 3/2000 Graber et al. ..... 128/202.14
6,142,167 A * 11/2000 Pettesch ..... 137/39
6,170,483 B1 * 1/2001 Ronjat ..... 128/201.11
6,250,325 B1 * 6/2001 Kim ..... 137/39
6,371,109 B1 * 4/2002 Taylor ..... 128/201.27
6,394,091 B1 * 5/2002 Giorgini ..... 128/206.21

* cited by examiner

*Primary Examiner*—Henry Bennett
*Assistant Examiner*—Kathryn Ferko

(57) ABSTRACT

An automatically closing ambient air device is disclosed having a generally conical passageway, containing an inlet for the flow of fluid from the ambient environment into the passageway and an outlet for the flow of such fluid from the passageway, and having valve means arranged to close fluid flow through the outlet from the passageway which is actuated by buoyant force and/or gravitational force and/or a combination thereof imposed by a weighted element in response to the spacial orientation of the conical wall of the passageway to level.

17 Claims, 3 Drawing Sheets

AMBIENT AIR BREATHING DEVICE

This invention relates to automatically closing ambient air breathing devices, generally useful with breathable air systems in hostile breathing environments. The device of the invention is particularly useful in association with underwater breathing apparatus, enabling the passage of ambient air to the user as desired, and automatically interrupting such passage when the ambient environment is hostile.

BACKGROUND OF THE INVENTION

The use of breathing systems in a non-breathable environment is well known. Breathable air systems are commonly used in high altitude aircraft, underwater diving, fire-fighting and various emergency situations wherein the surrounding environment is fouled or otherwise unsuitable for breathing. In the modern era, breathable air systems generally use full or partial face-mask and the like devices to conveniently supply the breathable air to the user upon demand. Such devices generally protect the user's eyes and face from the hostile environment and allow the user to keep his mouth free for communications and the like, by relying upon the attaining and maintaining of a reliable seal around a perimeter of the face, particularly the mouth and nose. To attain a reliable seal, the mask generally requires careful preparation, placement and fitting to the user and is not quickly and easily refitted upon removal.

Breathable air systems are generally uncomfortable under the best of circumstances and many breathable air assemblies comprise self-contained compressed air apparatus, enabling a user to move to and from a hostile environment under a work regiment wherein it is inconvenient to remove and refit a face-mask. Self-contained compressed air systems, have a limited supply of air, but are desired in many environments, the air being generally uncomfortable to breath in that it has a drying effect upon the mouth and throat of the user thus complicating the comfort of the user.

For the convenience and comfort of the user, ambient air devices have been developed which enable the user to manually switch to and from breathing air from a compressed or alternate air source and the ambient air, without removal of the breathing equipment. Such ability can reduce the rate of depletion of a limited supply of compressed air while at the same time provide relief from the drying effects of such compressed air. In many applications however, there are circumstances wherein the user may be in an ambient air breathing mode and without warning, or because of an incapacitation or the like, the user is unable to manually switch from the ambient air breathing mode to the compressed air system mode. For example, in the case of high speed watercraft racing, aircraft failure or other accident or the like, the user may be rendered disoriented, unconscious or otherwise unable to manually switch from the ambient air source to a compressed or other alternate air supply. Thus, there is a need for an ambient air device which automatically closes without manual action being taken by the user to switch from ambient breathing to compressed air or alternate air supply system.

It is an object of the present invention to provide a ambient air device which is convenient for use and durable in operation.

It is another object of the invention to provide an ambient air device which can be easily mounted to a face-mask and the like.

It is further object of the invention to provide an ambient air device which will automatically interrupt the supply of ambient air in emergency situations.

These and other objects of the invention will be apparent from the following description of the invention.

SUMMARY OF THE INVENTION

In accordance with the present invention, an automatically closing ambient air device is disclosed, comprising a housing having a generally conical passageway with an inlet for the flow of fluid from the ambient environment into the conical passageway and an outlet for the flow of fluid from the passageway to the user. The outlet to the user comprises valve means arranged to be actuated to close fluid flow from the passageway by buoyant force and/or gravitational movement of a weighted element in response to the spacial orientation of the conical wall of the passageway to level.

In a preferred embodiment of the invention, the generally conical passageway is arranged about a central axis, with the valved outlet being arranged toward or about at the base of the cone. A weighted element is arranged in the passageway to move toward and away from the base of the cone to engage and disengage the valve means and actuate closing, depending upon the orientation of the conical walls of the passageway to level. In a particularly preferred embodiment, the weighted element comprises a plurality of weighted balls which roll along the conical wall of the passageway toward or away from the base end of the passageway, in response to the spacial orientation of the conical wall of the passageway to level, to assist engagement of the valve means.

In a further preferred embodiment of the invention, the passageway comprises an axle, mounted at about opposite ends thereof within the passageway and extending along about a central axis of the passageway. The valve means comprises a buoyant element which is slidably mounted on the axle, arranged to slide axially along the axle from a first position spaced from the outlet being an open valve position, to a second position arranged to seal the outlet from the flow of fluid therethrough being the closed valve position.

In one embodiment, means are provided to manually engage the buoyant element to enable manually sliding the buoyant element from about the first position to the second position on the axle. The weighted element is arranged in the passageway between the buoyant element and the vertex end of the passageway, being arranged to assist movement of the buoyant element when the first position of the buoyant element is higher or about the same level in spacial orientation with the second position.

In a further preferred embodiment, the buoyant element comprises a flexible elastomeric surface, which is arranged to engage against a mating surface surrounding the opening of the outlet, so as to seal the flow of fluid from the passageway through the opening. In a particularly preferred embodiment, the outlet comprises a plurality of openings arranged around the central axis of the passageway, an end of the axle is mounted to structure crossing about the diameter of the passageway, and the buoyant element comprises a flexible elastomeric diaphragm arranged to engage a surface adjacent the plurality of openings so as to seal the flow of fluid through the openings.

In a particularly preferred embodiment, the shape of the housing defines the generally conical passageway and comprises a plurality of inlet openings therethrough arranged to enable flow of ambient air and/or ambient liquid into the passageway. The outlet of the passageway is positioned at the base of the conical passageway, and is arranged generally around the central axis of the passageway and is enabled for connection to a tubular conduit for the flow of ambient air from the conical passageway to the user. In a most preferred embodiment, the outlet comprises a plurality of openings in the base of the cone surrounding the outlet from the passageway.

In a particularly preferred embodiment the buoyant element comprises a generally cylindrical structure formed from and/or containing buoyant material, which is axially mounted along a generally central axle of the passageway. An end of the buoyant element is configured to sealingly engage a mating seat at about the outlet, to resist the flow of fluid from the passageway through the outlet. In a particularly preferred embodiment the end of the buoyant element comprises a flexible diaphragm which engages against an opening of the outlet to enable sealing the outlet.

It should be understood that the present invention contemplates multiple further diverse configurations and arrangements for automatically closing an outlet in accord with the spirit of the invention wherein buoyant force is assisted by gravitational force to seal an outlet of an ambient air device from passage of fluids. Thus for example, the buoyant element may comprise a ball and seat or the like arrangement for closing the outlet. The gravitation force may be exerted by a levered arrangement engaging the buoyant element rather than the preferred arrangement of the invention. These and other embodiments of the invention will be apparent from the following detailed description of the invention.

BRIEF DESCRIPTION OF THE DRAWINGS

The nature and mode of operation of the present invention is more fully described in the following detailed description of the accompanying drawings.

DETAILED DESCRIPTION OF THE INVENTION

Figure 1:
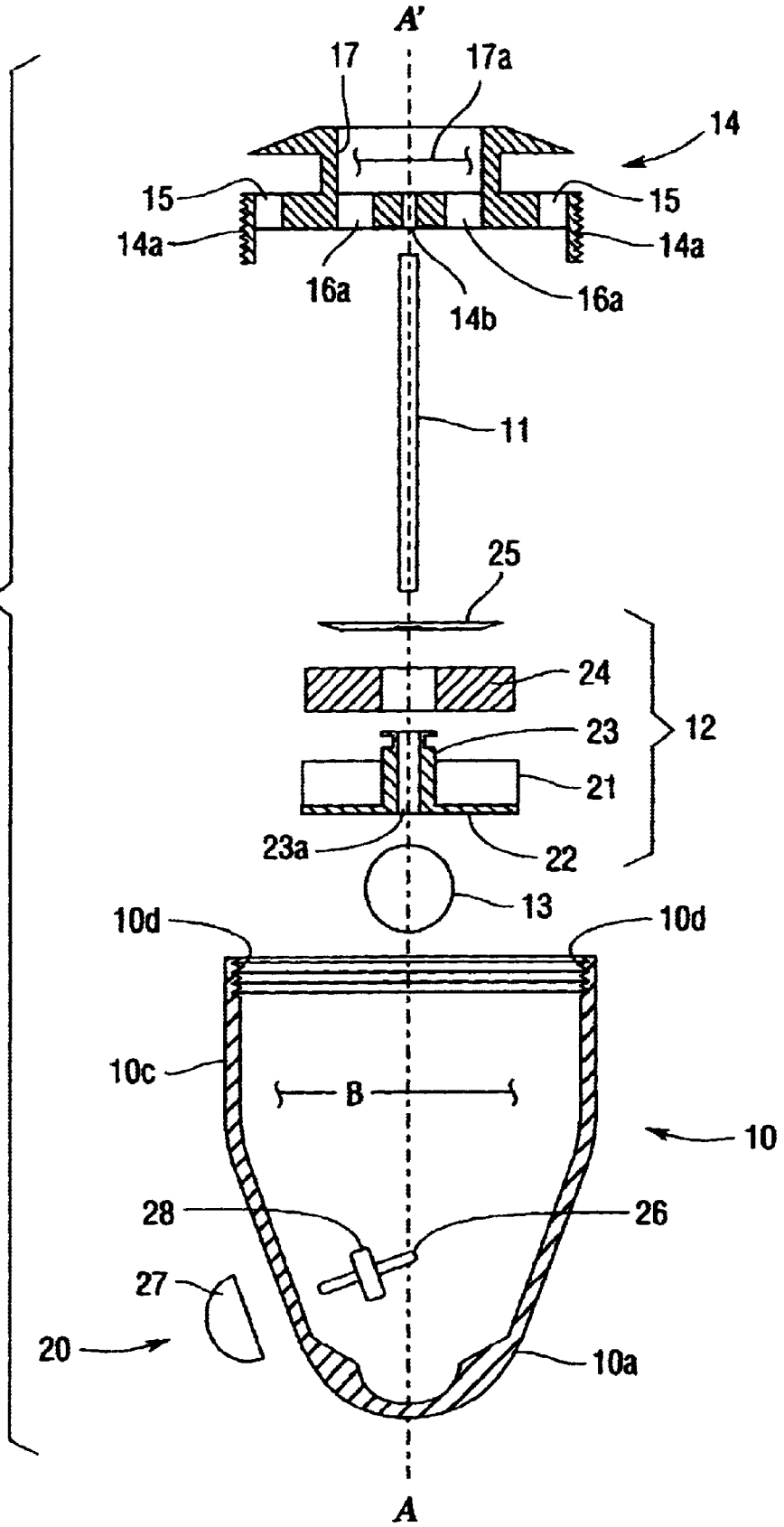
FIG. 1 is an exploded perspective view of an ambient air valve of the invention.
Figure 2:
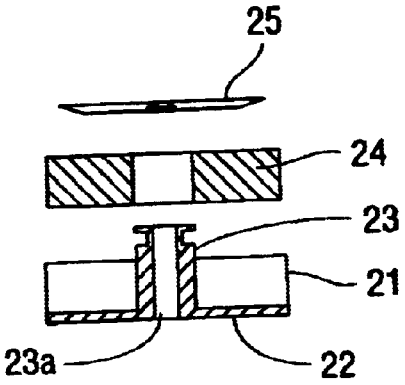
FIG. 2 is an exploded view of the buoyant element of FIG. 1.
Figure 5:
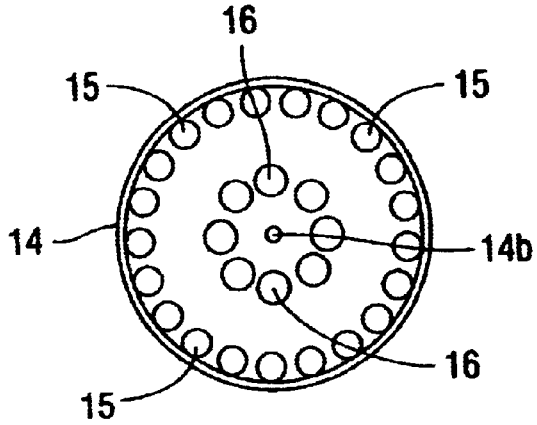
FIG. 5 is a bottom plan view of the base cap of the ambient air valve of FIG. 1.
Figure 3:
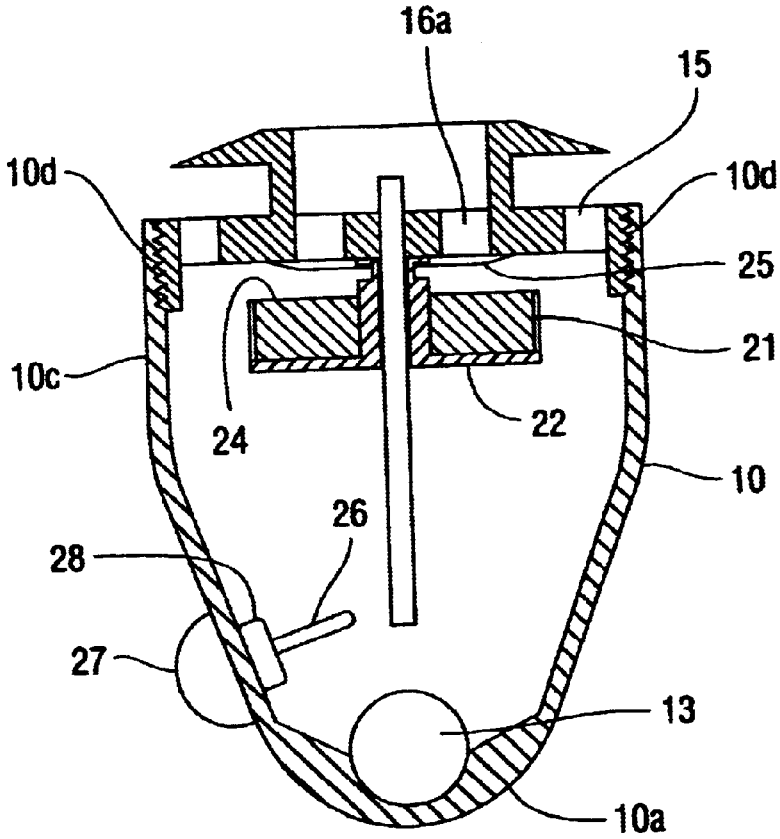
FIG. 3 is a partial sectional view of the ambient air valve of FIG. 1 wherein the outlet is closed.

Referring first to FIGS 1–5, therein is depicted a preferred embodiment of an ambient air device of the invention, wherein housing 10 defines a generally conical interior passageway "B" arranged around axle 11, laying along about centerline A–A' buoyant element 12 is mounted along axle 11, gravitational element 13 is arranged between vertex end 10*a* of conical passageway B and buoyant element 12, and base cap 14 is arranged for connection to about the base of conical passageway B and comprises a plurality of inlets 15 and outlets 16.

Housing 10 is illustrated as comprising slot 10*b* (FIG 4), which is sized to enable slidable engagement with manual closing element 20 thereto. Manual closing element 20 comprises engagement rod 26, rod cap 27 and rod grommet 28. Rod 26 is press fitted into rod cap 27 and inserted through slot 10*b*, with cap 27 being along the exterior of housing 10. Rod grommet 28 is fitted along rod 26 on the interior side of housing 10, and is dimensioned larger than slot 10*b*, the grommet and the cap being sized and arranged to retain the rod in position through the slot while allowing the rod to slide along the slot. Rod 26 is sized in length to extend from grommet 28 into the conical passageway and engage the underside of buoyant element 12, in an arrangement such that manually sliding the rod along the slot toward the base end of the conical passageway engages buoyant element 12 along axle 11, moving the buoyant element from a first position spaced from outlet openings 16*a* wherein the outlet from the conical passageway is open, to a second position wherein the buoyant element interacts with outlet openings 16*a,* closing the outlets to resist passage of fluids therefrom.

End 10*c* of housing 10, is internally threaded 10*d*, to enable threaded engagement with mating external threads 14*a* of base cap 14. Base cap 14 is illustrated as comprising a plurality of inlets 15, generally radially surrounding the plurality of outlet openings 16*a*. The plurality of outlet openings 16*a* are illustrated as opening into passageway 17*a* formed by shoulder 17 contained on the exterior surface of base cap 14, passageway 17*a* being in fluid communication with the user. The plurality of inlets 15 enable the continuous flow of ambient fluid from the surrounding environment into conical passageway B, while diaphragm means 25, cooperating and/or integral with the buoyant element is arranged to block ambient fluid flow from conical passageway B into passageway 17*a*. Hole 14*b* in base cap 14, is arranged about central to the base cap and is sized to accept axle 11, supporting one end thereof. A similar hole at the vertex end of conical passageway B may be provided for supporting the other end of axle 11.

Gravitational element 13 is depicted as being one or more weighted metal spheres arranged between vertex end 10*a* of conical passageway B and buoyant element 12. In functional operation, the sphere engages the buoyant element pushing it toward the lowest point of spacial orientation of the sides of the conical passageway. Generally, a plurality of spheres are arranged in the conical passageway and sized to engage the buoyant element and weighted so as to force the buoyant element along axle 11 toward the base of the conical passageway as they roll in that direction. A shock pad may be provided at about the vertex end to cushion the shock of the gravitational elements engaging the vertex end.

Buoyant element 12, is illustrated as comprising a cylindrical housing 21, having a base 22, containing an elongate central post 23, containing an opening 23*a* about centrally throughout its length, sized to slidingly mount over axle 11. Housing 21 contains buoyant material 24, which is packed around the central post so as to provide buoyancy to the element when in a liquid environment. Diaphragm 25 is arranged at the open end of the housing, the diaphragm and the cylindrical housing having about the same diameter, sized to cover the plurality of openings comprising the outlet from the conical passageway.

In functional operation, the buoyant element is mounted along axle 11 with the open end comprising the diaphragm adjacent the outlet openings. In a spacial orientation in liquid wherein the vertex mounted end of axle 11 is lower than the outlet mounted end, the buoyancy of the element will cause the element to move along the axle toward the outlet openings and thus the diaphragm to cover the outlet openings to resist passage of liquid through the outlet openings into the passageway to the user. In a spacial orientation in liquid wherein axle 11 is about level, or the vertex mounted end of axle 11 is higher than the outlet mounted end, the base end of the conical wall of the conical passageway will be lower in spacial orientation than the vertex end of the conical wall and the gravitational elements will roll along the wall engaging the buoyant element and forcing the buoyant element toward the outlet openings and thus the diaphragm to cover the outlet openings.

As should be apparent, the angular relationship among the conical walls of the conical passageway and axle 11, is such that in any spacial relationship wherein axle 11 is oriented about level or wherein the vertex end is higher than the base end at an angle not exceeding the angle of the conical side of the passageway to the axle, the gravitational elements will engage the buoyant element causing the diaphragm to engage the outlet openings leading to the passageway to the user. This particular relationship, provides a fail-safe automatic closing of the ambient air device when appropriately mounted to a face mask of a user.

Figure 4:
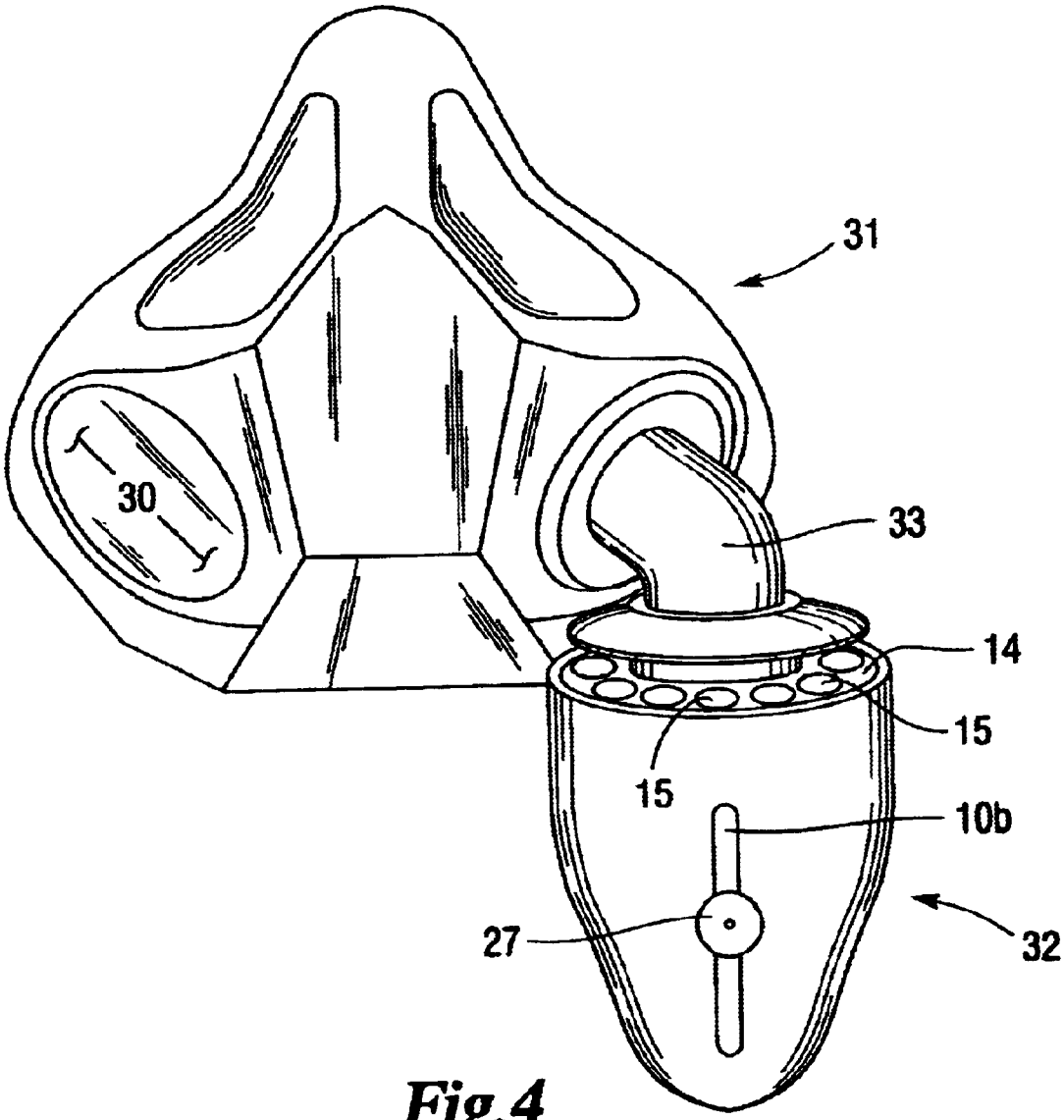
FIG. 4 is a perspective view of an ambient air valve of the invention mounted in a typical underwater mask arrangement.

Referring now to FIG 4, therein is illustrated an ambient air device 32 in a nose mask 31. Space 30 illustrates the position of a demand compressed air regulator (not shown), the ambient air device 32 being arranged opposite same with connector tube 33 being angled downwardly from the mask. Such arrangement is contemplated as a common arrangement for sporting and emergency activities wherein a self contained breathing apparatus with optional ambient air device is used in fouled air and/or underwater environments. In this arrangement, it is contemplated that when the ambient air device is open, and the user enters water and the like, the ambient air valve automatically closes limiting the users air source to compressed air demand. Such embodiment has particular utility in emergency underwater emersion situations such as high speed racing boat emergencies, SCUBA diving emergencies and even military aircraft water rescue situations, wherein a user is generally tethered to a compressed air source by means of a face mask to a primary breathable air source, but for reasons of comfort etc., also has an ambient air device to enable him to breath ambient air as the opportunity may present itself.

In FIG. 4, the positioning of the ambient device in the face mask assures the user that the ambient air device is open to the ambient air through a wide range of head movements in non-liquid environments, except wherein the user faces almost fully upward. Upon immersion in water, the ambient air valve automatically closes, primarily through operation of the buoyant element, assisted by the gravitational element when the spacial orientation of the face is level or upwardly oriented.

We claim:

1. An automatically closing ambient air device comprising:

a housing having a generally conical passageway having a conical wall extending from about a vertex end toward a base end, said housing containing an inlet for the flow of fluid from an ambient environment into said generally conical passageway and an outlet for the flow of fluid from said generally conical passageway to a user;

wherein valve means is arranged to close fluid flow from said generally conical passageway through said outlet to said user, said closing of fluid flow being actuated by a gravitational force imposed by a weighted element in response to a change in the spacial orientation of said conical wall of said generally conical passageway to level;

said housing comprising means to manually close fluid flow from said generally conical passageway through said outlet to said user, independent of spacial orientation of said conical wall.

2. The ambient air device of claim 1 wherein said valve means comprises a buoyant element.

3. The ambient air device of claim 2 wherein said buoyant element is slidably mounted on an axle arranged along about a centerline of said conical passageway.

4. The ambient air device of claim 3 wherein said conical passageway comprises said inlet at the base end thereof.

5. The ambient air device of claim 3 wherein said buoyant element comprises a diaphragm which engages around an opening of said outlet.

6. The ambient air device of claim 1 wherein said weighted element is arranged between said valve means and said vertex end of said conical passageway.

7. The ambient air device of claim 2 wherein said weighted element comprises a sphere, arranged to roll along said conical wall to engage said buoyant element.

8. The ambient air device of claim 1 wherein said housing is configured to define said conical passageway.

9. The ambient air device of claim 1 wherein said inlet and said outlet are comprised on said base end of said conical passageway.

10. The ambient air device of claim 9 wherein said inlet comprises a plurality of openings radially spaced from about a centerline of said base end.

11. The ambient air device of claim 10 wherein said inlet comprises a plurality of spaced openings radially surrounding about said centerline of said base end, and arranged between said centerline and said plurality of openings comprising said inlet.

12. An automatically closing ambient air device comprising:

a housing having a generally conical passageway having a conical wall extending from a vertex end toward a base end;

said base end comprising a plurality of first openings spaced from about a centerline of said base end for the flow of fluid into said generally conical passageway;

said base end comprising a plurality of second openings arranged between said first openings and about said centerline of said base end, said plurality of second openings comprising an outlet for the flow of fluid from said generally conical passageway to a user;

an axle, arranged along about a centerline of said generally conical passageway;

a buoyant element slidably mounted along said axle, said buoyant element comprising a flexible diaphragm sized and arranged to engage said plurality of openings comprising said outlet and closing said outlet from the flow of fluid from said generally conical passageway to said user;

a weighted element, arranged in said generally conical passageway, between said buoyant element and said vertex end of said generally conical passageway, said weighted element arranged to engage said buoyant element and close fluid flow from said generally conical passageway through said outlet to said user, in response to a change in the spacial orientation of said axle.

13. The ambient air device of claim 12 comprising means to manually close fluid flow from said generally conical passageway through said outlet to said user.

14. An automatically closing ambient air device comprising:

a housing having a generally conical passageway having a conical wall extending from about a vertex end toward a base end, said housing containing an inlet for the flow of fluid from an ambient environment into said generally conical passageway and an outlet for the flow of fluid from said generally conical passageway to a user, said inlet and said outlet comprised on said base end of said generally conical passageway;

wherein valve means is arranged to close fluid flow from said generally conical passageway through said outlet to said user, said closing of fluid flow being actuated by a gravitational force imposed by a weighted element in response to a change in the spacial orientation of said conical wall of said generally conical passageway to level.

15. The device of claim 14 wherein said inlet comprises a plurality of spaced openings radially surrounding a centerline of said base end.

16. The device of claim 15 wherein said outlet comprises a plurality of spaced openings radially surrounding about said centerline of said base end, and arranged between said centerline and said plurality of openings comprising said inlet.

17. The ambient air device of claim 14 comprising means to manually close fluid flow from said passageway through said outlet to said user.

* * * * *